United States Patent [19]

de Mattos

[11] 4,089,560

[45] May 16, 1978

[54] SEAT DEVICE

[75] Inventor: Jorge Jose de Mattos, Encino, Calif.

[73] Assignee: John J. Posta, Jr., Encino, Calif. ; a part interest

[21] Appl. No.: 816,399

[22] Filed: Jul. 18, 1977

Related U.S. Application Data

[63] Continuation-in-part of Ser. No. 761,316, Jan. 21, 1977.

[51] Int. Cl.[2] ..... A47C 4/02

[52] U.S. Cl. ..... 297/441; 297/442; 297/457

[58] Field of Search ..... 297/441, 442, 457, 45; 5/122, 129, 114; 248/435, 434, 150

[56] References Cited

U.S. PATENT DOCUMENTS

| | | | |
|---|---|---|---|
| 412,338 | 10/1889 | Hurlburt | 248/435 X |
| 717,119 | 12/1902 | Potter | 5/122 |
| 2,347,821 | 5/1944 | Goldner | 297/442 X |
| 2,504,902 | 4/1950 | Strople et al. | 248/150 |
| 2,689,602 | 9/1954 | Morgan | 297/45 |
| 2,702,586 | 2/1955 | Borgfeldt | 297/441 |
| 3,407,001 | 10/1968 | Minsker | 297/442 X |
| 3,729,229 | 4/1973 | Minsker | 297/442 |

FOREIGN PATENT DOCUMENTS

| | | | |
|---|---|---|---|
| 104,806 | 5/1963 | Netherlands | 297/457 |
| 40,585 | 5/1916 | Sweden | 5/129 |
| 184,250 | 8/1936 | Switzerland | 297/45 |

*Primary Examiner*—Francis K. Zugel
*Attorney, Agent, or Firm*—John J. Posta, Jr.

[57] ABSTRACT

An improved seat device is provided which comprises a plurality, preferably two, of intersecting, generally flat unitary rigid support members of generally U- or modified H-shape, each of the support members comprising a generally horizontal crosspiece interconnecting a pair of spaced generally vertical legs, the crosspieces being loosely interconnected at notched portions, so that the legs can be angled from the vertical during use of the device to wedge the crosspieces together for greater stability. One end of the legs forms a base support. The device also includes a flexible seat member connected to and hanging down between the legs at a distance from the base support, as through pegs, notches, etc. in the legs and loops, holes, etc. in the seat member. Preferably, the positioning of the seat member is adjustable on the legs. The device is easily assembled and just as easily disassembled and compactly stored. It can be made of a total of three single pieces, without hinges, bolts, etc. It adjusts to a person's weight while sitting or lying therein, and is stable, durable and inexpensive.

10 Claims, 4 Drawing Figures

SEAT DEVICE

This is a continuation-in-part of my co-pending U.S. patent application, Ser. No. 761,316, filed Jan. 21, 1977, entitled "A SEAT CONSTRUCTION".

BACKGROUND OF THE INVENTION

1. Field of the Invention

The present invention generally relates to seat devices and more particularly to easily assembled and disassembled seat devices, such as chairs, loungers and the like of improved construction, stability and adjustability.

2. Prior Art

The usual types of chairs and couches, loungers and the like for use within the home are of solid rigid permanently assembled construction, are upholstered and are expensive, heavy, large and difficult to move and to store. Lighter weight lawn furniture is usually made of metal and also is somewhat expensive. Most of such lawn furniture normally employs a series of hinged sections so that it can be easily folded and stored or unfolded and used. Such hinged devices have a tendency to rust and pit and to rapidly depreciate in appearance and in function. Moreover, in many instances, the hinged nature of such furniture renders them unstable in use unless properly and carefully deployed and locked in place.

There remains a need for simple furniture, particularly seat devices readily employable indoors and outdoors and which are inexpensive, durable, light in weight, employ few, if any, moving parts, hinges, etc., which are not likely to malfunction or to provide instability, and which preferably are readily, rapidly and easily assembled, adjusted, disassembled, and stored in a minimum of space and time, without the use of tools.

SUMMARY OF THE INVENTION

The foregoing needs have now been satisfied by the improved seat construction of the invention, that is, the seat device of the present invention. The device is substantially as set forth in the Abstract above. It need employ no hinges, locks, swivels, bolts, nuts or the like. Instead, in its simplest form, it utilizes a pair of essentially identical, flat, rigid contoured support members, preferably of rust-free material, such as wood or plastic, each support member comprising a horizontal crosspiece to the ends of which are attached generally vertical legs. The device also includes a flexible seat member of canvas or other durable material or the like.

The support members intersect and are loosely releasably interconnected through notches in the intersecting crosspieces thereof. The loose interconnection enables a degree of relative movement between the support members for easy assembly and disassembly, while providing for a stump mating thereof to form an equivalent unitary and integral structure when supporting a body, due to the angular forces generated at the notches. These forces are generated in substantially the horizontal plane of crosspieces, with the forward legs being braced towards one another and the rear legs also being braced towards one another. The notches are dimensioned relative to the thickness of the support members to permit the solid portion of each crosspiece in each notch to move and allow angling of the legs away from the vertical for improved stability of the device, increased adjustment and comfort to the load-imposing parts of the body and releasable automatic locking of the support members together.

The seat member hangs between the support members and is releasably secured thereto, as by loops or openings at the periphery of the seat member disposed over the legs. Preferably, the legs have tapered loop-receiving ends, or pegs or notches to permit wedging securement of the seat member therewith, yet easy and rapid adjustment, disassembly, and storage (as well as assembly of the device), all without tools. Many alternate means of securing the seat member to the support members can be employed. Such securing means could readily take the form of openings in the top portion of each leg, through which loops attached to the seat member can be passed, which loops then have a rod passed through to prevent movement of the loop back through the opening, until disassembly is desired. Various other advantages and features of the invention are set forth in the following detailed description and accompanying drawings.

DRAWINGS

DETAILED DESCRIPTION

FIGS. 1–3

Figure 3:
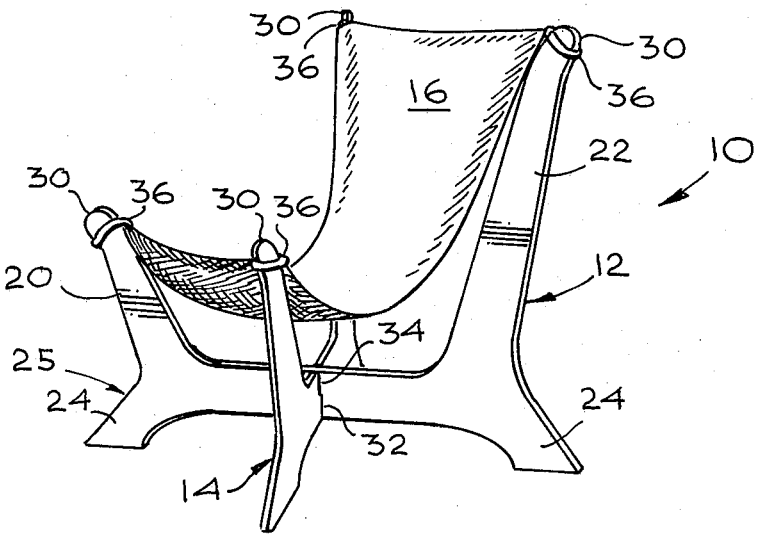
FIG. 3 is a schematic perspective view of a first preferred embodiment of the improved seat device of the present invention, employing two support members essentially as shown in FIGS. 1 and 2.

Now referring more particularly to FIG. 3 of the accompanying drawings, a first preferred embodiment of the improved seat device of the present invention is schematically depicted therein. Thus, device 10 is shown which comprises a pair of essentially identical intersecting support members 12 and 14, and a flexible seat member 16 releasably secured thereto, as shown.

Figure 1:
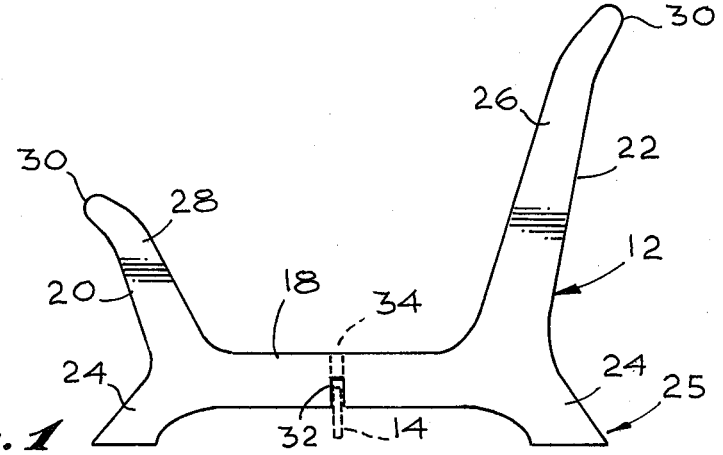
FIG. 1 is a schematic side elevation of a first preferred embodiment of a support member for the improved seat device of the present invention.
Figure 2:
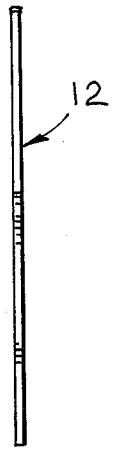
FIG. 2 is a schematic front elevation of the support member of FIG. 1.

Seat member 12 is shown in detail in FIG. 1 and comprises a generally horizontally extending crosspiece 18, to opposite ends of which are secured generally vertical front leg 20 and rear leg 22. It will be noted that leg 22 is longer than leg 20 and that the portions 24 of legs 20 and 22 protruding below crosspiece 18 are short and of equal length and form a base 25 for device 10. Portion 26 of leg 22 is substantially longer than portion 28 of leg 20. Portions 24 diverge somewhat from each other, as do portions 26 annd 28 from each other. The upper ends 30 of portions 26 and 28 are tapered. Member 12 is straight and flat in front view (FIG. 2), is unitary, and is contoured in side view for a pleasing aesthetic appearance and improved strength.

Crosspiece 18 defines a rectangular notch 32 running from the bottom edge thereof vertically upwardly (at the center of the length thereof) to about the midpoint thereof. The width of notch 32 is somewhat greater than the thickness of member 12 and member 14, a portion of member 14 being shown in phantom outline therein. Notch 32 preferably is angled directly across (at a 90° angle to) the longitudinal axis of crosspiece 18 so that member 14 is receivable within notch 32 at a 90° angle from, that is, about perpendicular to the main plane of crosspiece 18, as shown in FIG. 3.

Member 14, as shown in FIG. 3 is in all respects, except one, identical to member 12. Accordingly, it bears the same numerals. Member 14 has a notch 34, which is identical in size and shape to notch 32, but extends in contract to notch 32, from the upper edge of its crosspiece 18 at the midline down to the midpoint thereof, as shown in phantom outline in FIG. 1.

If desired, notch 32 and/or 34 can be angled at an angle of less than 90° relative to the longitudinal axis of the crosspieces if one desires to alter the overall design characteristics of the seat device.

When it is desired to releasably join members 12 and 14 together in the assembly of device 10, members 12 and 14 are placed in the upright position and then member 12 is placed down over member 14 so that the portion of member 12 directly above notch 32 nests in notch 34, and so that notch 32 encloses the portion of member 14 immediately below notch 34. Thus, member 12 and 14 are made to fit together and intersect to each other (FIG. 3). All that is needed to complete the assembly of device 10, is to slip flexible seat member 16, such as a contoured canvas sheet, down between legs 20 and 22 while releasably engaging loops 36 over the tapered ends 30 thereof. Ends 30 widen downwardly, so that when seat member 16 is sat upon, loops are wedged tighter over ends 30.

The looseness of fit between the portions of crosspieces 18 received within notches 32 and 34 permits, upon a body being located on the seat member, slight angling of legs 20 and 22 to (a) releasably and automatically lock members 12 and 14 together, (b) increase the stability of device 10, and (c) automatically adjust device 10 for proper support of the weight of the user of device 10. When the device is assembled and no body rests therein, a loose connection exists at the notches. However, when a body rests on the seat portion, the front, cross-portion of the seat member draws the forward legs of each support member to be drawn towards one another, thereby causing the notched portions facing front-ward to be clamped together. Likewise, the rear cross-portion of the seat member draws the rear legs of each support member to be drawn towards one another, thereby causing the notched portions facing rearward to be clamped together. The clamping pressure at the notches is magnified due to the high torque developed thereat because of the multiplication of the weight times the torque arm (about one-half the length of the cross-piece). The resulting operative structure permits a very rigid interconnection comparable favorably to a unitized, integral device.

Thus, device 10 is simple, inexpensive, attractive, can be made durable, preferably of rust-proof non-metallic or organic material (e.g., wood, plastic or the like) and cloth, and can be used equally well inside and outside the home, office, etc. It can be assembled very quickly without tools, is stable and is easily disassembled and stored flat in a very small space.

FIG. 4

Figure 4:
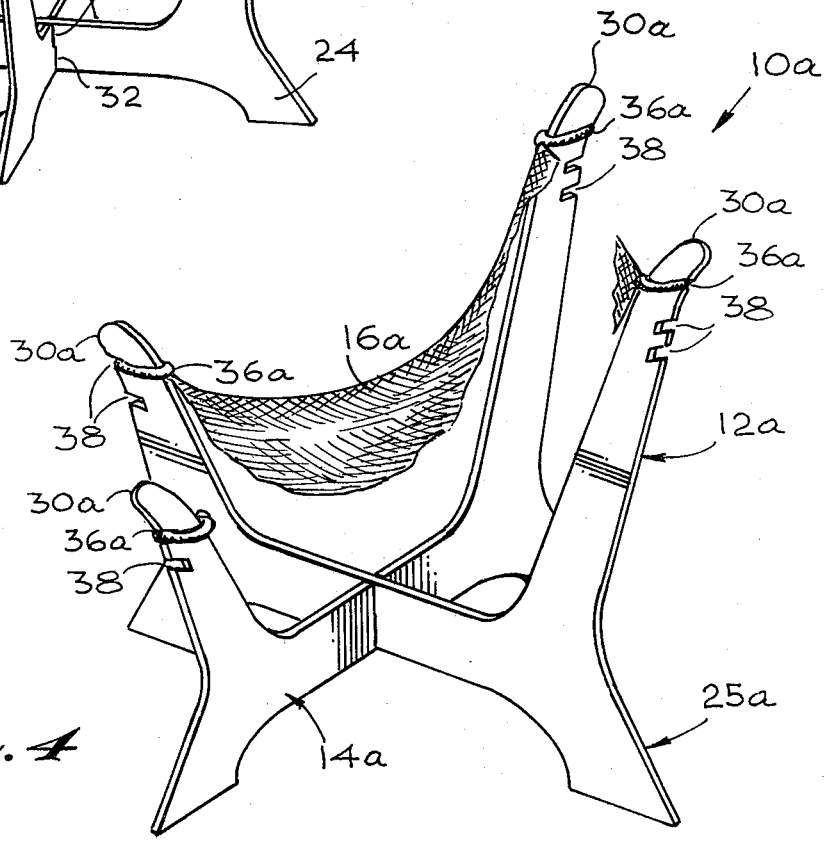
FIG. 4 is a schematic perspective view, partly broken away, of a second preferred embodiment of the improved seat device of the present invention.

A second preferred embodiment of the improved device of the present invention is schematically depicted in perspective view in FIG. 4. Thus device **10*a* is shown, which is substantially similar to device 10. Those components of device 10*a* which are substantially identical to those of device 10** bear the same numerals but are succeeded by the letter "*a*".

Device **10*a* comprises an intersecting pair of support members 12*a* and 14*a*, releasably secured together to a seat member 16*a* (shown partly broken away). Member 16*a* includes loops 36*a* releasably secured over ends 30*a*, each of which bears a plurality of vertically spaced notches 38 directed inwardly and downwardly (for improved wedging action) from the outer margins thereof. Loops 36*a* are disposed in selected ones of notches 38 so as to permit adjustment of member 16*a* to any desired height within members 12*a* above base 25*a*. Thus, device 10*a* has the advantages of device 10** plus seat adjustability.

Various other features and advantages of the present invention are as set forth in the foregoing. Various modifications, changes, alterations and additions can be made in the present device, its components and parameters. All such modifications, changes, alterations and additions as are within the scope of the appended claims form part of the present invention.

What is claimed is:

1. An improved readily assembled adjustable seat device, said device comprising, in combination:

a. a seat support comprising a plurality of generally U-shaped intersecting support members, each said support member comprising a crosspiece interconnecting a pair of spaced generally parallel legs, each said crosspiece including a notched portion, said crosspieces being loosely releasably interconnected at said notched portions to permit limited adjustment of spacing and angle between said legs, said legs collectively defining at one common end thereof a base support for said device;

b. a flexible seat member of extended surface area releasably connected to said legs along the length thereof remote from said base support, whereby said seat member hangs between said legs above said base support;

c. said seat member having a flexible rear portion extending between the rear parallel legs which imparts an attractive force to such legs when a body rests on said seat members;

d. said seat member further having a flexible forward portion extending between the forward parallel legs which imparts an attractive force to such legs when a body rests on said seat member; and, e. whereby the attractive forces tend to generate a locking force at the point of intersection of said crosspieces to provide a rigid base support.

2. The improved seat device of claim 1 wherein said crosspieces are disposed generally horizontally and below said seat member and wherein said legs are disposed generally vertically, with the upper ends of said legs releasably secured to said seat member.

3. The improved seat device of claim 2 wherein said seat member includes a plurality of flexible loops adjacent its extremities and releasably disposed around said leg upper ends and wherein said leg upper ends are tapered and curved to impart a wedging and securing action to said loops when said seat member is sat upon.

4. The improved seat device of claim 1 wherein said crosspieces are disposed generally horizontally adjacent the lower end of said legs, wherein said legs extend generally vertically and wherein said crosspiece notches are dimensioned to permit sufficient of said leg slanting from vertical to effect adjustable wedging and bracing of said crosspieces for improved stability of said device in use.

5. The improved seat device of claim 4 wherein said seat member includes a plurality of flexible loops adjacent its extremities.

6. The improved seat device of claim 1 wherein said device has two of said intersecting rigid support members, wherein each said support member is generally flat, unitary and of modified H-shape, with each leg thereof projecting in two opposite directions from the point of interconnection with said crosspiece.

7. The improved seat device of claim 6 wherein the notches of both said crosspieces are centered relative to the length thereof, the notch of one of said crosspieces extending up from the lower edge of said crosspiece to about the midpoint thereof, while the notch of the other of said crosspieces extends down from the upper edge of said crosspiece to about the midpoint thereof.

8. The improved seat device of claim 7 wherein said support members are of rust-resistant organic material and wherein said seat member comprises a canvas sheet, one leg of each said support member being shorter than the other, adjacent legs of said support members being of similar height.

9. An improved seat device comprising:

a seat support means, and a seat member, said seat support means including a first support member having a plurality of vertically extending legs and a first transverse member interconnecting said legs, said first transverse member having a notch on the bottom side thereof, said seat support means including a second support member having a plurality of vertically extending legs and a second transverse member interconnecting said legs, said second transverse member having a notch on the top side thereof, said first transverse member adapted to be removably fitted into the notch in the second transverse member simultaneously with the removably fitting of the second transverse member into the notch in the first transverse member, said seat member being removably suspended from the upper portions of all said vertically extending legs, said seat member being flexible having an extended surface area, whereby the weight of a body on said seat member will cause the rearward portion of said seat to impart a horizontally directed force on two rear, vertically extending legs tending to draw such legs together, and whereby the weight of a body in said seat member will further cause the forward portion of said seat to impart a horizontally directed force on two forward, vertically extending legs tending to draw such legs together, wherein a locking force is generated in the vicinity of the notches to lock said transverse members into a unitary support structure.

10. The improved seat device of claim 9 wherein said support means are flexible.

* * * * *